US008246364B2

(12) United States Patent
Chen

(10) Patent No.: US 8,246,364 B2
(45) Date of Patent: Aug. 21, 2012

(54) POWER STRIP WITH SAFETY COVER

(75) Inventor: Song-Ya Chen, Shenzhen (CN)

(73) Assignees: Fu Tai Hua Industry (Shenzhen) Co., Ltd., ShenZhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 114 days.

(21) Appl. No.: 12/915,057

(22) Filed: Oct. 29, 2010

(65) Prior Publication Data

US 2012/0083144 A1 Apr. 5, 2012

(30) Foreign Application Priority Data

Sep. 30, 2010 (CN) ..... 2010 1 0298241

(51) Int. Cl.
*H01R 13/44* (2006.01)

(52) U.S. Cl. ..... 439/145; 439/136; 439/346

(58) Field of Classification Search ..... 439/145, 439/143, 147, 144, 346, 140, 136, 137
See application file for complete search history.

(56) References Cited

U.S. PATENT DOCUMENTS

| | | | | |
|---|---|---|---|---|
| 5,026,299 | A * | 6/1991 | Foulk | 439/137 |
| 6,602,081 | B1 * | 8/2003 | Wang | 439/145 |
| 2011/0256745 | A1 * | 10/2011 | Shin | 439/136 |

* cited by examiner

*Primary Examiner* — Hae Moon Hyeon
(74) *Attorney, Agent, or Firm* — Altis Law Group, Inc.

(57) ABSTRACT

A power strip includes a base, a casing, at least one latching member, and at least one first elastic member. The case includes at least one cover. Each cover includes at least one first hook. The cover is able to move between a first position and a second position. Each latching member is slidably connected to the base and includes at least one second hook. Each first elastic member is received in the base and capable of providing a spring force to keep one cover to be in the first position. When the cover is moved to the second position, the first hook engages the second hook to keep the cover in the second position. When the latching member is operated to cause the first hook disengages from the second hook, the cover is pushed to the first position due to the spring force of the first elastic member.

13 Claims, 8 Drawing Sheets

POWER STRIP WITH SAFETY COVER

BACKGROUND

1. Technical Field

The present disclosure relates to power strips and, particularly, to a power strip with a safety cover.

2. Description of Related Art

Power strips are universally used in our lives. A power strip can accommodate a number of plugs. However, it may be troublesome for a user to remove a plug from a power strip if the plug is tightly plugged into the power strip. Moreover, if the users' hand is wet, the user may suffer from electric shock while removing the plug.

BRIEF DESCRIPTION OF THE DRAWINGS

The components of the drawings are not necessarily drawn to scale, the emphasis instead being placed upon clearly illustrating the principles of a power strip with safety cover. Moreover, in the drawings, like reference numerals designate corresponding parts throughout several views.

DETAILED DESCRIPTION

Embodiments of the present disclosure will now be described in detail below, with reference to the accompanying drawings.

Figure 1:
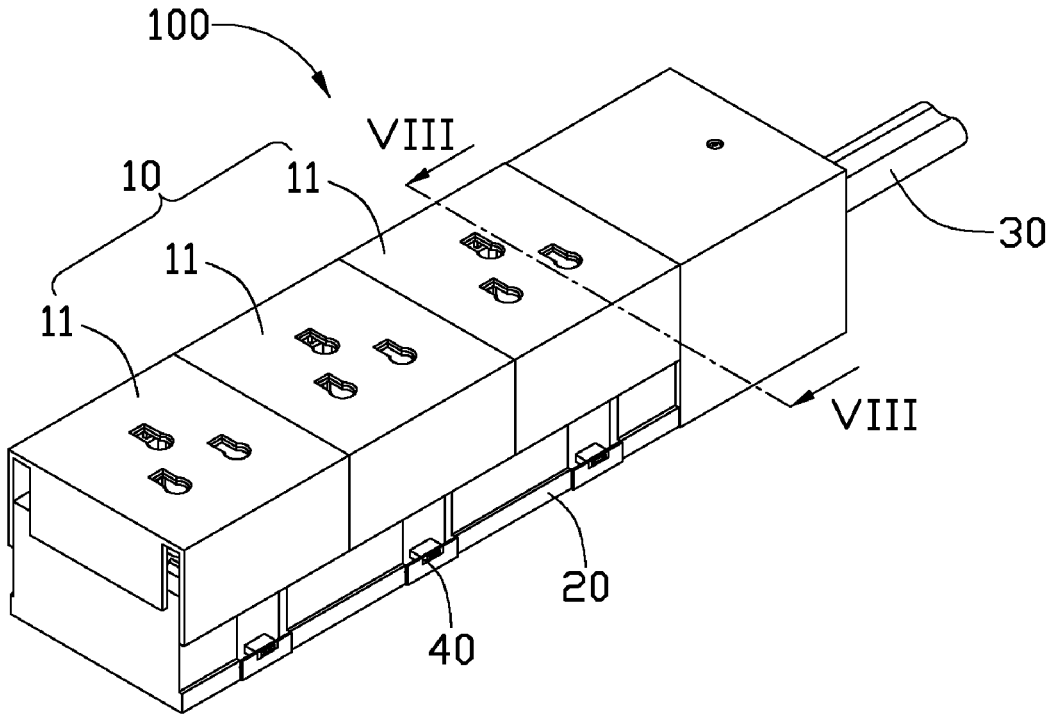
FIG. 1 is an isometric view of a power strip in accordance with an exemplary embodiment.
Figure 2:
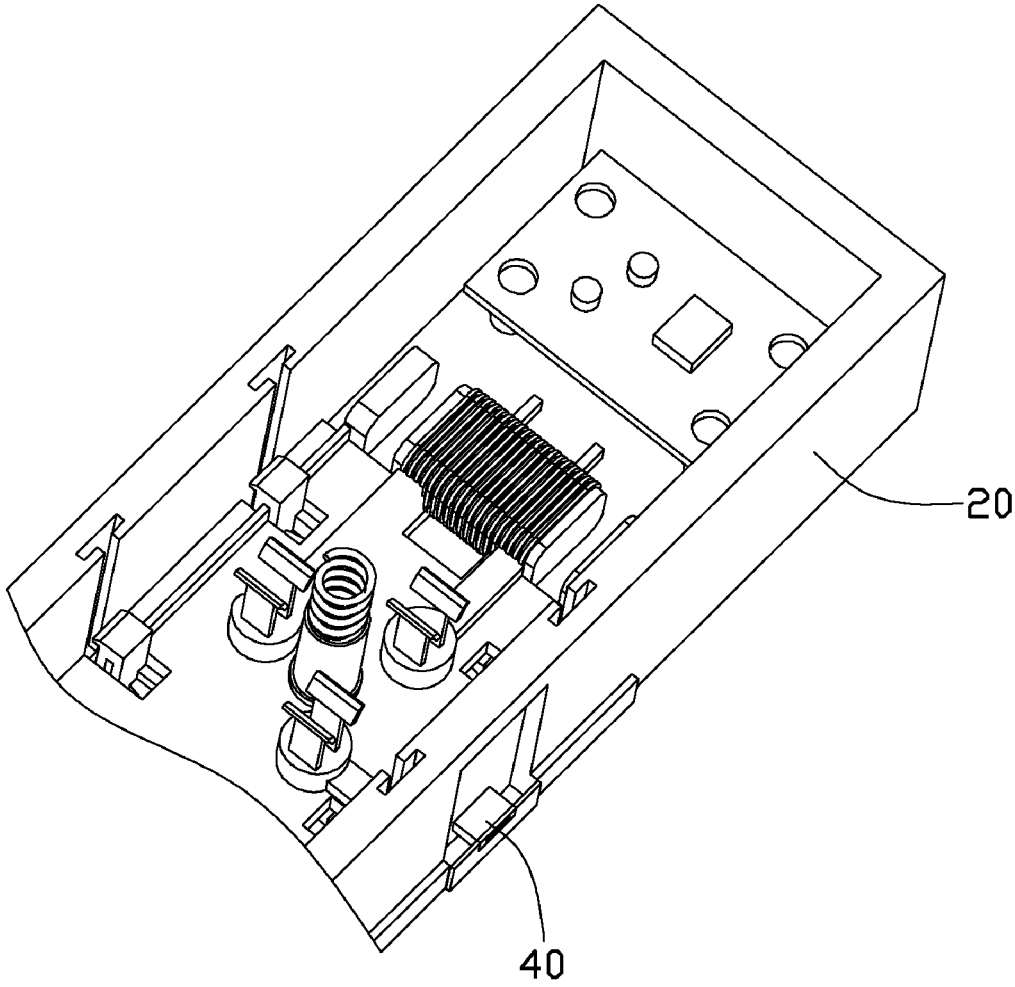
FIG. 2 is a partial, isometric view of the power strip of FIG. 1, showing an interior structure of the power strip.

Referring to FIGS. 1-2, a power strip 100 includes a casing 10, a base 20, a wire 30, and at least one latching member 40. The casing 10 includes at least one cover 11. The at least one latching member 40 latches the at least one cover 11 to the base 20, in the embodiment, there are three covers 11 and two latching members 40 are deployed to latch one cover 11 to the base 20. One end of the wire 30 is connected to the base 20.

Figure 3:
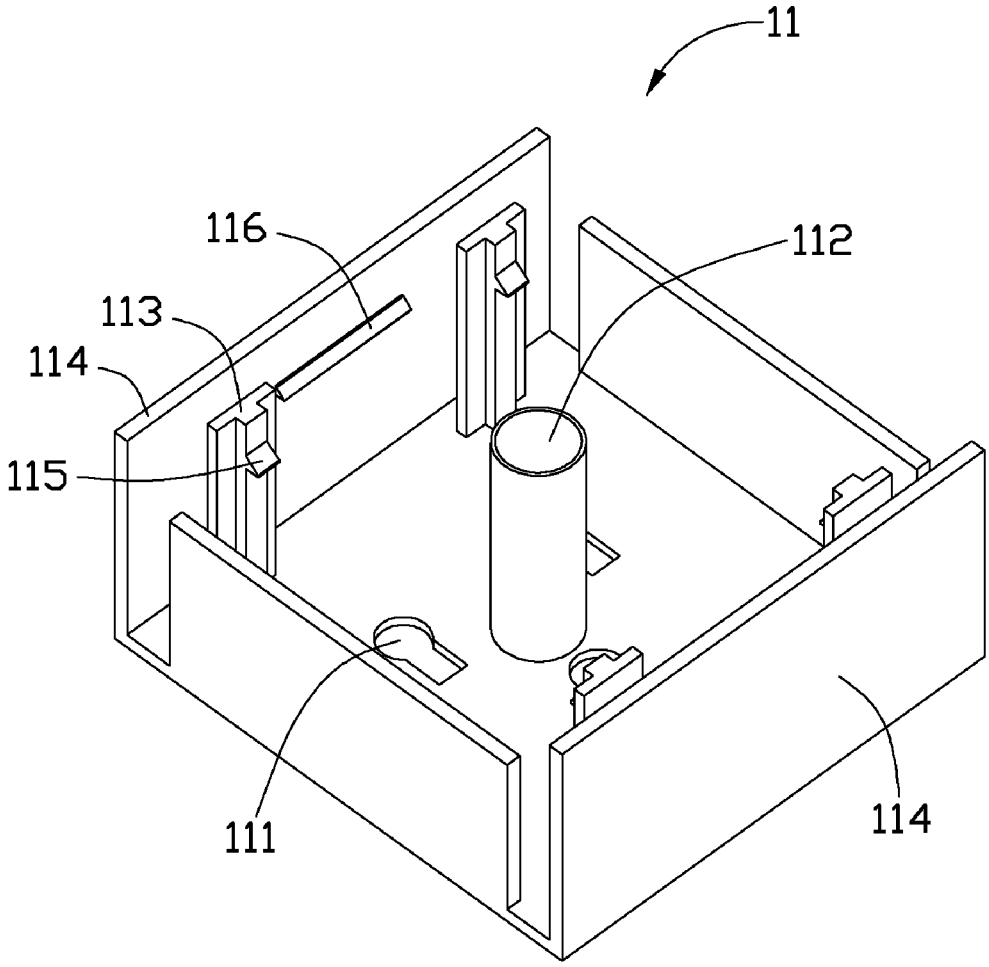
FIG. 3 is an isometric view of a cover of the power strip of FIG. 1, viewed from another viewpoint.

Referring to FIG. 3, a top surface of each cover 11 defines a number of through holes 111. In the embodiment, the through holes 111 can accommodate either a grounded 3-pin or a non-grounded 2-pin plug. In an alternative embodiment, the through holes 111 can only accommodate a grounded 3-pin plug. In another alternative embodiment, the through holes 111 can only accommodate a non-grounded 2-pin plug. A first sleeve 112 and at least one guide member 113 protrudes from a lower surface of each cover 11. Each guide member 113 is adjacent to one of opposite sidewalls 114 of the cover 11. In this embodiment, four guide members 113 are deployed, and two of the guide members 113 are adjacent to one of the sidewalls 114 and substantially parallel to each other, and the other guide members 113 are adjacent to the other sidewall 114 and substantially parallel to each other. A first hook 115 protrudes from each guide member 113 and faces the first sleeve 112. Two stopper portions 116 respectively protrude from the sidewalls 114. In this embodiment, each stopper portion 116 is arranged between and substantially perpendicular to two guide members 113.

Figure 4:
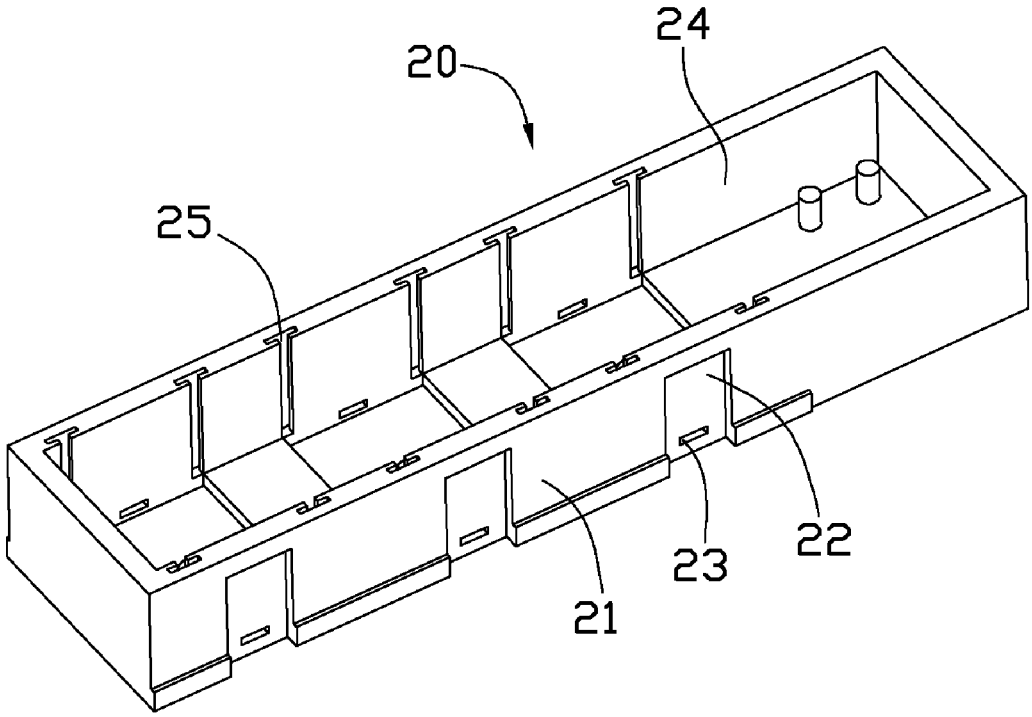
FIG. 4 is an isometric view of a base of the power strip of FIG. 1.

Referring to FIG. 4, the two opposite outer sidewalls 21 of the base 20 respectively define a number of recessed portions 22. Each stopper portion 116 hooks a top sidewall of one recessed portion 22. The bottom of each recessed portion 22 defines a through opening 23. A portion of each latching member 40 is operable through one through opening 23. Two opposite inner sidewalls 24 of the base 20 respectively define a number of guide slots 25 corresponding to the guide members 113. Each guide slot 25 is substantially perpendicular to the bottom of the base 20. Each recessed portion 22 is arranged between two guide slots 25. Each guide member 113 is slidably received in one guide slot 25, and the first hooks 115 are external to the guide slots 25.

Figure 5:
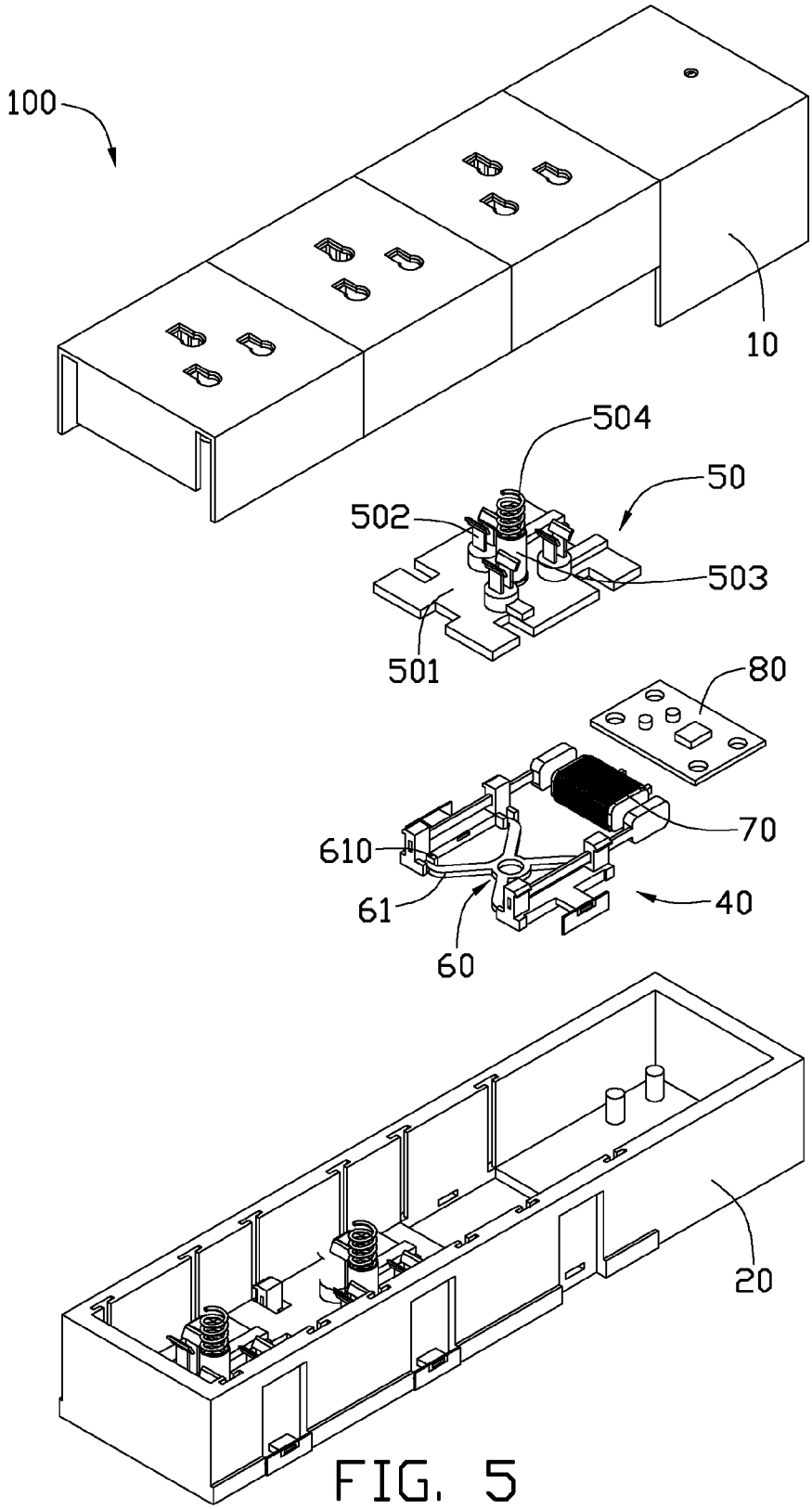
FIG. 5 is a partially exploded, perspective view of the power strip of FIG. 1.

Referring to FIG. 5, the power strip 100 further includes a number of support members 50 and a number of elastic members 60. One support member 50 and one elastic member 60 correspond to one cover 11. The support members 50 and the elastic members 60 are attached to the bottom of the base 20. Each support member 50 includes a support plate 501, a number of contacts 502, a second sleeve 503, and an elastic member 504. The support plate 501 is fixed to the bottom of the base 20. The contacts 502 are attached to the support plate 501 and are electrically connected to the wire 30. Each contact 502 corresponds to one through hole 111. The second sleeve 503 protrudes from the support plate 501. The outer diameter of the second sleeve 503 is less than the inner diameter of the first sleeve 112. The elastic member 504 is partially received in the second sleeve 503, and one end of the elastic member 504 is attached to the support plate 501. The elastic member 504 can provide a spring force to cause the bottom of the casing 10 to be spaced from the base 20.

Each elastic member 60 is arranged below one support plate 501 and includes at least two elastic arms 61. The joint of the arms 61 are attached to the bottom of the base 20. In the embodiment, each elastic member 60 includes four elastic arms 61 arranged in X-shaped. Each elastic arm 61 includes a free end 610.

Figure 6:
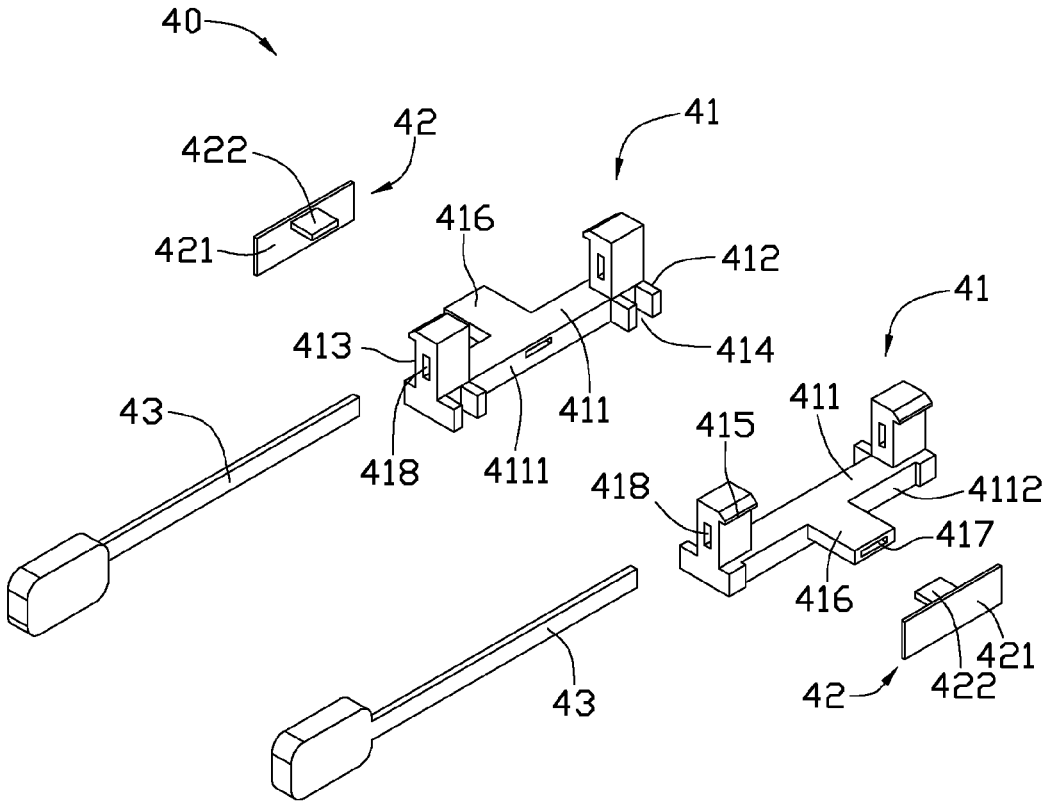
FIG. 6 is an exploded, perspective view of a latching member of the power strip of FIG. 1.

Referring to FIG. 6, each latching member 40 includes a resisting member 41. The resisting member 41 includes a main body 411, two pairs of limiting members 412, and at least one projection 413. The main body 411 is slidably connected to the base 20. The main body 411 includes a first sidewall 4111 and a second sidewall 4112. The first sidewall 4111 is opposite to the second sidewall 4112. Each pair of limiting members 412 protrudes from an end of the first sidewall 4111. In the embodiment, each pair of limiting members 412 is parallel to each other and forms a gap 414. The free ends 610 of the elastic arms 61 are respectively received in the gaps 414. Each projection 413 protrudes from the top surface of the main body 411. In the embodiment, two projections 413 are deployed and respectively protrude from opposite ends of the top surface of the main body 411. Each projection 413 includes a second hook 415. The second hook 415 is opposite to the guide slot 25 and capable of engaging the first hook 115.

In the embodiment, each resisting member 41 further includes an extending member 416. The extending member 416 extends from the second sidewall 4112 of the main body 411. In the embodiment, the extending member 416 extends from the middle of the second sidewall 4112. Each extending member 416 extends through one through opening 23 of the base 20 and is partially external to the base 20. The free end of the extending member 416 defines a groove 417. Each latching member 40 further includes a pressing member 42. The pressing member 42 includes a plate 421 and a securing member 422 substantially perpendicular attached to the plate 421. Each securing member 422 is received in one groove 417, and the plate 421 is external to the base 20 for users to operate.

Initially, the cover 11 is kept in a first position under the spring force of the elastic member 504, and in the first position, the stopper portions 116 respectively hook the top sidewalls of the recessed portions 22. To plug a plug (not shown) into the power strip 100, the plug is inserted into the through holes 111 of the cover 11, causing the guides members 113 to move down in the guide slot 25 until the cover 11 reaches a second position. At this point, the elastic member 504 is compressed, the plug is electrically connected to the power strip 100, and the first hooks 115 engage the second hooks 415.

To remove the plug, the plates 421 of the latching members 40 employed to latch the cover 11 are simultaneously pressed, causing the resisting members 41 to compress the elastic member 60 until the second hooks 415 disengage from the first hooks 115. At this point, the cover 11 is pushed to be in the first position and the plug is driven to be separated from the power strip 100 under the spring force of the elastic member 504. When the pressing members 421 are released, the elastic members 60 rebound to return the resisting members 41 to their initial state.

In other embodiment, each projection 413 further defines a through hole 418 substantially parallel to the main body 411. Each latching member 40 further includes a push strip 43. The push strip 43 is made of metal or magnetic material. Each push strip 43 extends through two through holes 418. The power strip 100 further includes a number of magnetic members 70 and a number of circuit boards 80. One magnetic member and one circuit board correspond to one cover. The magnetic member 70 is arranged between two push strips 43. When current flows through the magnetic member 70, the push strips 43 are attracted to move toward the magnetic member 70, causing the resisting members 41 to move toward the elastic member 60 to compress the elastic member 60.

Figure 7:
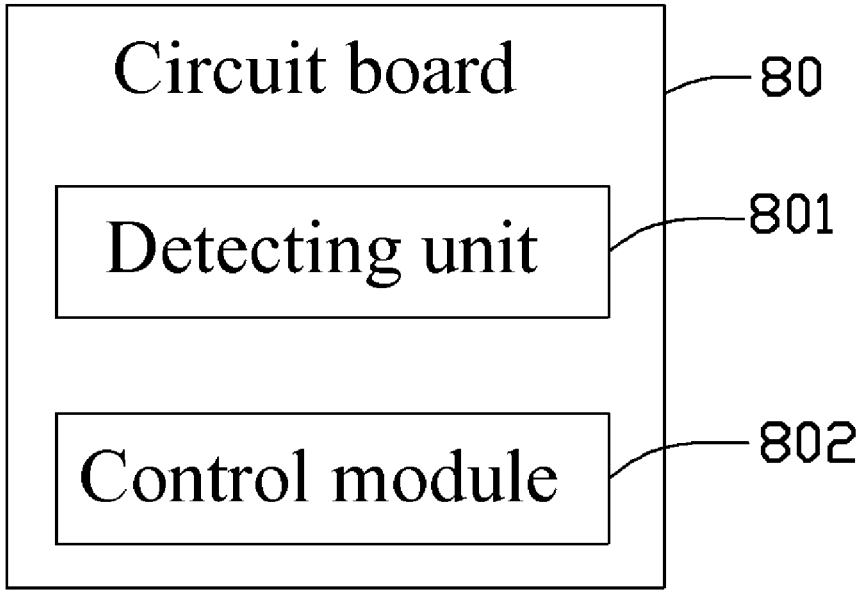
FIG. 7 is a block diagram of a circuit board of the power strip of FIG. 1.
Figure 8:
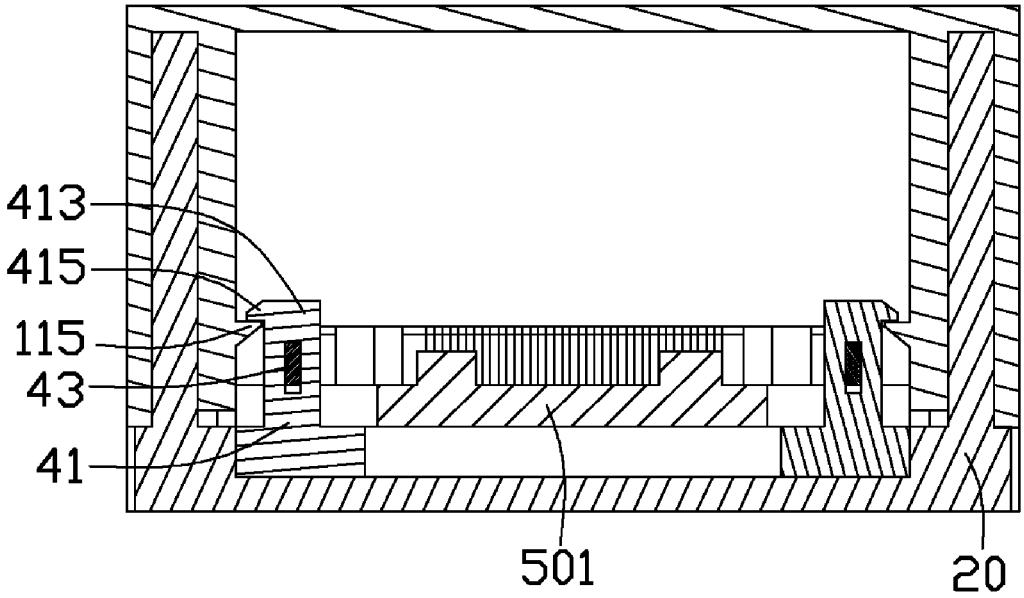
FIG. 8 is a sectional view of the power strip of FIG. 1, taken along line VIII-VIII.

When the plug of a chargeable device is plugged into the through holes 111 of one cover 11, current exists between the chargeable device and the power strip 100, when the chargeable device has been charged, the value of the current between the chargeable device and the power strip 100 decreases to a minor value slightly greater than zero. Referring to FIG. 7, each circuit board 80 includes a detecting unit 801 and a control unit 802. The detecting unit 801 detects whether the value of the current between the power strip 100 and the chargeable device reaches a predetermined value, which represents that the chargeable device has been charged, and further detects whether the value of the current reaches zero, which represents that the chargeable device and the power strip have been disconnected. The control module 802 allows the current to flow the magnetic member 70 if the value of the current between the power strip 100 and the chargeable device reaches the predetermined value. In addition, interrupts the current provided to the magnetic member 70 if the value of the current between the power strip 100 and the chargeable device is greater than the predetermined value or reaches zero.

When the current flows the magnetic member 70 attracts the resisting members 41 to compress the elastic member 60 until the second hooks 415 are disengaged from the first hooks 115. At this point, the elastic member 504 rebounds to return the cover 11 to the first position. Therefore, with such configuration, when the chargeable device is charged, the power strip 100 can automatically push the cover 11 to the first position, thus the chargeable device and the power strip 100 are disconnected. When the chargeable device and the power strip 100 are disconnected, the value between the chargeable device and the power strip 100 reaches zero, the control unit 802 interrupts the current provided to the magnetic member 70, thus the elastic member 60 rebounds to push the resisting members 40 to their original position.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A power strip comprising:

a base comprising a plurality of contacts;

a casing comprising at least one cover, each of the at least one cover defining a plurality of through holes each of which is corresponding to one of the contacts, a plug plugging into the power strip through the through holes, each of the at least one cover comprising at least one first hook, the cover being able to move between a first position and a second position;

at least one latching member slidably connected to the base and partially external to the base for users to operate, each of the at least one latching member comprising at least one second hook;

at least one first elastic member received in the base, each of the at least one first elastic member capable of providing a spring force to one of the at least one cover to keep the one of the at least one cover to be in the first position;

wherein, when the cover is moved to the second position where the contacts are electrically connected to the plug, the at least one first hook engages the at least one second hook to keep the cover in the second position, when the latching member is operated to cause the at least one first hook disengages from the at least one second hook, the cover is pushed to the first position due to the spring force of the first elastic member.

2. The power strip as described in claim 1, wherein the base defines at least one through opening, each of the at least one latching member comprising a resisting member and a pressing member, the resisting member comprises a main body and an extending member, the main body is slidably connected to the base, the extending member extends from the main body, extends through one of the through opening and is external the base, the pressing member is connected to the extending member and operable.

3. The power strip as described in claim 2, wherein the free end of the extending member defines a groove, each of the at least one pressing member comprises a plate and a securing member, the plate is operable, the securing member is securely connected to the plate, each of the at least one securing member is received in one of the grooves.

4. The power strip as described in claim 2, furthering comprises at least one second elastic member, wherein the second elastic member comprises at least two elastic arms, the joint of the at least two elastic arms are fixed to the base.

5. The power strip as described in claim 4, wherein the resisting member further comprises two pair of limiting members, each pair of limiting members extends from the sidewall of the main body and forms a gap, each of the free ends of the elastic arm is received in one of the gaps.

6. The power strip as described in claim 1, wherein each of the at least one cover comprises a stopper portion, the base defines at least one recessed portion, each of the at least one stopper portion hooks a top sidewall of one recessed portion.

7. The power strip as described in claim 1, wherein at least one guide member protrudes from the cover, the inner sidewall of the base defines at least one guide slot, each of the at least one guiding member is slidably received in one of the at least one guiding slot.

8. The power strip as described in claim 1, wherein the power strip comprises at least one supporting member, each of the at least one supporting member comprises a supporting plate, the supporting plate is fixed to the base, one second sleeve protrudes from one of the supporting plates, one end of one first elastic member is attached to one supporting plate.

9. The power strip as described in claim 8, wherein at least one first sleeve protrudes from one of the covers, the outside diameter of each of the at least one first sleeve is larger than the inside diameter of each of the at least one second sleeve, the first sleeve is capably of being received in the second sleeve.

10. The power strip as described in claim 1, wherein each of the at least one latching member comprises a resisting member, the resisting member comprises a main body and at least one projection, the main body is slidably connected to the base, each of the at least one projection protrudes from the main body and defines a through hole, each of the at least one latching member comprises a push strip made of metal and magnetic material, each of the at least one push strip extends through the through hole of the at least one projection, the power strip further comprises at least one magnetic member and at least one circuit board, each of the at least one magnetic member is attached to the base, each of the at least one circuit board comprises a detecting unit and a controlling module, the detecting module is configured to determine whether the power of the current flows between the plug and the power strip reaches a predetermined value, if the power of the current flows between the plug and the power strip reaches a predetermined value, the controlling module allows the current to flow the magnetic member.

11. The power strip as described in claim 10, further comprising at least one second elastic member, wherein the second elastic member comprises at least two elastic arms, the joint of the elastic arms are fixed to the base.

12. The power strip as described in claim 11, wherein the resisting member further comprises two pair of limiting members, each pair of limiting members extends from the sidewall of the main body and forms a gap, each of the free ends of the elastic arm is received in one gap.

13. The power strip as described in claim 10, wherein when the value of the current between the plug and the power strip is greater than the predetermined value or reaches zero, the controlling module interrupt the current provided to the magnetic member.

* * * * *